US007494148B2

(12) United States Patent
Muscatelli

(10) Patent No.: US 7,494,148 B2
(45) Date of Patent: Feb. 24, 2009

(54) BOARD BINDING

(75) Inventor: Arnaud Muscatelli, Divonne les Bains (FR)

(73) Assignee: E. I. du Pont de Nemours and Company, Wilm, DE (US)

( * ) Notice: Subject to any disclaimer, the term of this patent is extended or adjusted under 35 U.S.C. 154(b) by 235 days.

(21) Appl. No.: 11/606,749

(22) Filed: Nov. 30, 2006

(65) Prior Publication Data

US 2007/0187928 A1 Aug. 16, 2007

Related U.S. Application Data

(60) Provisional application No. 60/740,806, filed on Nov. 30, 2005.

(51) Int. Cl.
*A63C 9/00* (2006.01)

(52) U.S. Cl. ..... 280/611; 280/14.21; 280/14.24; 280/626

(58) Field of Classification Search ..... 280/611, 280/14.21, 14.24, 613, 618, 620, 625, 626, 280/11.3, 14.22, 619
See application file for complete search history.

(56) References Cited

U.S. PATENT DOCUMENTS 3,950,001 A * 4/1976 Weigl ..... 280/618
3,975,034 A * 8/1976 Weigl et al. ..... 280/618
5,190,311 A 3/1993 Carpenter et al.
2004/0113392 A1 6/2004 Elkington
2004/0169350 A1 9/2004 Elkington

FOREIGN PATENT DOCUMENTS

EP 0 836 869 A2 4/1998
FR 2 840 224 12/2003
WO WO 97/31687 9/1997
WO WO 2005/049156 A2 6/2005

OTHER PUBLICATIONS

PCT International Search Report and Written Opinion for International Application No. PCT/US2006/046005 dated Apr. 18, 2007.

* cited by examiner

*Primary Examiner*—Christopher P Ellis
*Assistant Examiner*—Bridget Avery

(57) ABSTRACT

A binding, in particular a snowboard binding comprises a base plate; a heel-cradling element; a toe-cradling element; an instep-strapping arrangement having a long part connected to one side of the base plate and a short side part connected to the other side; a closure device for the instep-strapping arrangement; and a flexible linkage connecting the closure device of the instep-strapping arrangement and the toe-cradling element. In an open position the toe-cradling element is free to move, and in a closed position the flexible linkage pulls the toe-cradling element, so the foot is secured between the toe-cradling element, the heel-cradling element and the instep-strapping arrangement. In this closed position the held-together parts of the instep-strapping arrangement hold a foot securely by forces acting between these parts through the closure device, independently of the need to maintain tension in the flexible linkage.

25 Claims, 5 Drawing Sheets

BOARD BINDING

This application claims the benefit of U.S. Provisional Application No. 60/740,806, filed Nov. 30, 2005.

CROSS REFERENCE

This application cross references U.S. application Ser. No. 60/740,753 entitled "Binding with Adjustable Heel-Cup Frame" concurrently filed Nov. 30, 2005 by inventor Arnaud Muscatelli, the contents whereof are incorporated herein by way of reference.

FIELD OF THE INVENTION

The present invention relates to a binding for holding a foot on a flat surface. More particularly, the present invention relates to a binding for holding a foot on a board used for riding on snow and other surfaces that can be used with any regular soft boot or foot. Generally the binding can be used for holding a foot on a flat surface of a board having an opposite side that is adapted to allow the board to be used to slide or glide relative to a support interface be it snow, water or the air, or to roll over a solid support surface when the board is fitted with rollers.

BACKGROUND OF THE INVENTION

Snowboarding has become increasingly popular in the last decade. The binding that holds the rider's feet onto the board plays an important role in ensuring safety, comfort and maneuverability.

The most popular conventional soft bindings for snowboarding use a two-strap system in which the boot of the rider is placed on a plate that is fastened to the snowboard, and held in place by a first strap that is fastened over the toes and a second strap that is fastened over the instep. This type of system suffers the drawback that the two straps must be manually fastened over the foot of the rider, requiring the rider to bend over, and often to remove hand wear, in order to close the binding. This conventional system uses a "ratchet and ladder" closure means that has no "memory" of the closure tension.

Attempts have been made to make snowboard bindings having "step-in" characteristics that are common in downhill ski bindings. For example, a common "step-in" system uses a base plate having a clipping mechanism, which can lock on a corresponding mechanism fixed on the sole of the boot. This type of "step-in" suffers the drawback that a particular binding can only be used with a corresponding boot since the mechanism on the binding must mate with the mechanism on the boot. In addition, because the attachment to the board is over a smaller area, and the outsole of the boot includes part of the coupling mechanism and no strap supports pass over the boot, the boot must be made rigid over some portions, to provide support to the foot and ankle. This renders the boot less comfortable. Rigid boots are also less popular because the snowboard piloting is less precise.

Another type of "step-in" system has been proposed, that attempts to combine the convenience of "step-in" systems with the control levels attainable with two-straps, called the "BACK-IN" system. An example is the Flow/K2 binding system that has similarities to a two-strap binding, except that the foot enters the binding through the back (which then clips into place) rather than the top. A single webbing that covers most of the foot and is held on by straps holds down the rider's boot. The BACK-IN binding suffers the drawback that the rigidity is increased because of the rigidity of the high back, and the overall feeling and pressure repartition over the boot is rougher compared to a conventional soft two-strap binding.

The following disclosures regarding other snowboard bindings systems have been proposed and may be briefly summarized as follows:

U.S. Pat. No. 5,190,311 discloses a snowboard binding system in which a binding for one boot is connected to a binding for another boot by cables via a tensioning means allowing both boots to be released in case of an abnormal load on one boot.

U.S. patent application No. 2004/0113392 discloses a snowboard binding having a support structure with a base plate and side plates that project from the base plate. Tension cables, which hold a single instep element, are attached to the side plates. The instep element extends from a toe region of the boot up to at least its instep region. A single tensioning device for the tension cables is independent of a pivoting position of a heel element.

EP 0 836 869-A2 discloses a snowboard binding in which a toe-strap and an instep strap are connected by cables to a lever located behind the heel, by which the tension on the toe- and instep straps can be controlled.

WO 97/31687 discloses a snowboard binding with a toe-strap assembly and an ankle-strap assembly connected by cables to a tensioning device which ends with a looped handle that the rider can pull to tighten both the toe strap assembly and ankle-strap assembly.

WO 2005/049156 discloses a snowboard binding in which a toe-strap and an ankle-strap are connected by a cable system, one of the straps having a ratchet-and-pawl type closure cooperating with a strap ladder to simultaneously tighten the toe and ankle straps. By actuating the closure more or less, the tension on the two straps is increased or decreased.

In the last three types of snowboard binding disclosed above, the toe and ankle straps are both held under tension by the cables. This is undesirable because of the poor distribution of holding forces and potentially dangerous because if a cable ruptured, the rider's boot could abruptly leave the snowboard in dangerous conditions.

It is desirable for a binding, adapted in particular for snowboarding, that offers the desired features of the best conventional two-strap systems, in particular the support and safety offered by the instep-strap and the excellent control offered by a well-adjusted toe-strap assembly, that is receptive to regular soft boots thus ensuring comfort and better control of the snowboard, that is convenient as regards placing a soft boot in the binding with a step-in function, and also convenient for securing the boot adequately and for releasing the boot.

SUMMARY OF THE INVENTION

Briefly stated, and in accordance with one aspect of the present invention, there is provided a board binding for holding a foot on a first side of a flat surface having two sides opposite one another wherein a second side of said flat surface is used to slide over other surfaces that said second side contacts, said binding comprising:

a base plate;

a heel-cradling element fastened to the base plate;

a toe-cradling element fastened to the base plate, and capable of moving forward and backward relative to a foot placed in the binding;

an instep-strapping arrangement having a first part connected to one side of the base plate and a second part connected to the other side of the base plate, a closure device for the instep-strapping arrangement, the closure device having an open position in which said first and second parts of the instep-strapping arrangement are open or easy-to-open, and a closed position in which said first and second parts are firmly held together, and a flexible linkage connecting the closure device of the instep-strapping arrangement and the toe-cradling element, the flexible linkage being arranged such that:

when the closure device is in the open position the toe-cradling element is free to move forwards and backwards, and when the closure device is in the closed position the flexible linkage transmits a tension to the toe-cradling element to move it backward to fit around a toe part of a foot in the binding, such that the foot is secured between the toe-cradling element, the heel-cradling element and the instep-strapping arrangement;

wherein when the closure device is in the closed position the held-together first and second parts of the instep-strapping arrangement hold a foot securely in the closed instep-strapping arrangement by forces acting between said first and second parts through the closure device, independently of the need to maintain tension in the flexible linkage.

Pursuant to another aspect of the present invention, there is provided a combined instep-strapping arrangement and closure device adapted to be fitted in a board binding for holding a foot on a first side of a flat surface having two sides opposite one another wherein a second side of said flat surface is used to slide over other surfaces that second side contacts, said binding comprising: a base plate; a heel-cradling element fastened to the base plate; and a toe-cradling element fastened to the base plate and capable of moving forward and backward relative to a foot placed in the binding;

the combined instep-strapping arrangement and closure device comprising:

an instep-strapping arrangement having a first part connectable to one side of the base plate and a second part connectable to the other side of the base plate, a closure device for the instep-strapping arrangement, the closure device having an open position in which in use said first and second parts of the instep-strapping arrangement are open or easy-to-open, and a closed position in which said first and second parts are firmly held together, and a flexible linkage for connecting the closure device of the instep-strapping arrangement to the toe-cradling element, the flexible linkage being arranged such that, in use:

when the closure device is in the open position the toe-cradling element is free to move forwards and backwards, and when the closure device is in the closed position the flexible linkage is able to transmit a tension to the toe cradling element to move it backward to fit around a toe part of a foot in the binding, such that the foot is secured between the toe-cradling element, the heel-cradling element and the instep-strapping arrangement;

wherein in use when the closure device is in the closed position the held-together first and second parts of the instep-strapping arrangement can hold a foot securely in the closed instep-strapping arrangement by forces acting between said first and second parts through the closure device, independently of the need to maintain tension in the flexible linkage.

Moreover, when the closure device is in the closed position the held-together first and second parts of the instep-strapping arrangement hold a foot securely in the closed instep-strapping arrangement by forces acting between the aforesaid first and second parts through the closure device, independently of the need to maintain tension in the flexible linkage. The binding according to the invention thus provides all of the desirable features of the best conventional two-strap systems, in particular the instep-strapping arrangement provides secure support and safety. In a preferred embodiment, the binding of the invention is used as a snowboard binding, in which case the rider wears a boot. The binding is receptive to regular soft boots thus ensuring comfort and better control of a snowboard. The binding is convenient as regards placing a foot/boot in the binding with a step-in function, due to the flexible linkage. It is also convenient for securing the foot/boot adequately between the instep-strapping arrangement and the toe-cradling element, and for releasing the foot/boot.

Due to the fact that the closure of the instep-strapping arrangement is independent of the tension applied by the flexible linkage, secure strapping of the instep-strapping arrangement is guaranteed, whereas the toe-cradling element can be held against the toe-part of the foot with a lighter tension. Each part then fulfils its purpose optimally: the instep-strapping arrangement providing the main holding of the foot (which accounts for about 70-80% of the total holding forces), whereas the toe-cradling element performs mainly a guiding/stabilizing function. The rider's control of a snowboard is therefore optimized. Moreover, because the flexible linkage does not contribute to the main securing of the foot, it can be made of lightweight materials. Even in case of rupture of the flexible linkage, the foot remains firmly held in place by the instep-strapping arrangement.

The invention thus avoids the safety problems and poor distribution of the holding forces that are inherent in the previous snowboard binding systems with a flexible linkage.

The binding according to the invention is entirely compatible with existing bindings of the two-strap type and can be supplied either as a complete binding, or as a combined instep-strapping arrangement and closure device adapted to be retro-fitted in an existing two-strap binding.

When retro-fitted to an existing binding, this combined instep-strapping arrangement and closure device results in a binding according to the invention providing all of the advantages outlined above.

BRIEF DESCRIPTION OF THE DRAWINGS

The invention will be more fully understood from the following detailed description, taken in connection with the accompanying drawings, in which.

Figure 1A:
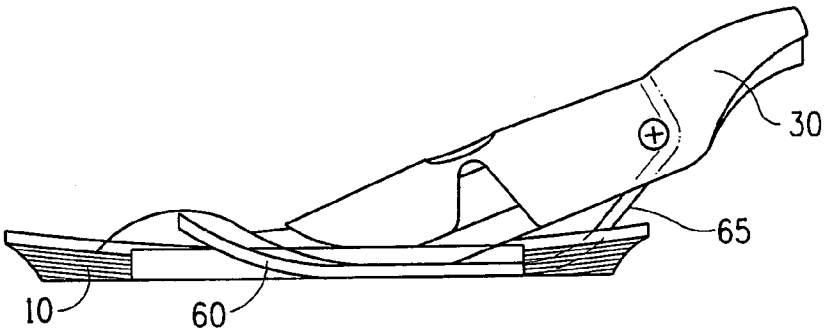
FIG. 1A is a partial view corresponding to FIG. 1, showing a detail of a variation.

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

DETAILED DESCRIPTION OF THE INVENTION

In the present invention, there is provided a binding for use on boots where the foot needs to remain on the surface of the board including snowboards and wakeboards where the rider may be barefooted.

References in the specification and the accompanying claims to "foot" include instances where the foot is bare and also where the foot is covered by footwear, in particular a boot in the case of a snowboard binding.

In a preferred embodiment, the closure device for the instep-strapping arrangement comprises a lever pivotally mounted on the first part, a connector slidably mounted on the second part and an abutment on the second part for limiting sliding of the connector. In the closed position of the closure device the lever pulls the connector against the abutment to close the instep-strapping arrangement, and in the open position of the closure device the connector is allowed to slide on said second part.

This connector can be a piece in the form of a loop, preferably of metal, having parallel sides that are slidably mounted on the second part of the instep-strapping arrangement, the loop having one end that faces the first part and that is adapted to engage with the lever, and an opposite end that faces where the second part is connected with the base plate, this opposite end being able to abut against the abutment to limit sliding of the loop, the flexible linkage being connected to said opposite end of the loop. To maximise force transfer, preferably the abutment has inclined abutment surfaces for engagement of corresponding portions of said opposite end of the loop that are inclined to the loop's opposite sides. The lever can have a series of recesses for selective engagement with the connector to adjust the size of the instep-strapping arrangement when the closure device is in the closed position. This type of closure is known and enables the size to be set by a "memory" through the rider's choice of a particular recess that provides the right fit. This "memory" type of closure is to be contrasted with the "ratchet and ladder" type closure which is pulled by the user until the ratchet engages with the ladder at a position that can be set by feel but not by memory.

The first part of the instep-strapping arrangement can be a long part that fits over the instep whereas the second part is a short side part. The lever can be pivotally connected adjacent to a free end of the first part that fits over the instep, the lever being movable to the closed position by pivoting away from the second part until the lever comes to lay over a portion of the first part in the vicinity of its free end.

The binding preferably includes a safety lock for releasably holding the lever in a closed position.

The binding's flexible linkage usually includes at least one cable preferably made of steel or aramid fibre. This cable can be partly sheathed.

In one embodiment the toe-cradling element is pivotally secured to the base plate at one side only, allowing the toe-cradling element to move forward and backward on the base plate by pivoting. In this case, the flexible linkage can extend along only one side of the binding, from the instep-strapping arrangement's closure device to the free end of the toe-cradling element. In this way, the flexible linkage can be made up of a short length of cable.

The heel-cradling element of the binding according to the invention comprise a heel-cup frame of generally U-shape in plan view, the heel-cup frame having side arms connected to opposite sides of the base plate in a manner allowing longitudinal adjustment of the position of the heel-cup frame. The first and second parts of the instep-strapping arrangement can be connected at opposite sides to the two arms of the heel-cup frame.

Preferably, the arms of the heel-cradling element are inclined at an angle up to 30° to the plane of the base plate. Combined with the longitudinal length adjustment, this advantageously provides an automatic height adjustment in proportion to the size of the rider's boots.

The retro-fittable combined instep-strapping arrangement and closure device can further comprise a toe-cradling element adapted to be fastened to the base plate so as to be capable of moving forward and backward relative to a foot placed in the binding, the toe-cradling element being adapted to be connected to the flexible linkage. Preferably, the toe-cradling element is adapted to be secured to the base plate at one side only, allowing the toe-cradling element to move forward and backward on the base plate by pivoting about its fixed end, and wherein the flexible linkage is arranged to extend along only one side of the binding, from the instep-strapping arrangement's closure device to the free end of the toe-cradling element.

The retro-fittable combined instep-strapping arrangement and closure device can incorporate all of the above-described features of the closure device of the instep-strapping arrangement.

In all embodiments, the binding is fully adjustable, so that the rider can choose settings according to his/her size and skill. Particularly preferably, the closure device can be locked in a setting chosen by the rider, so that no adjustments need to be made each time the rider steps into the binding.

Reference is now made to the drawings for a detailed description of the present invention. The snowboard binding shown in FIG. 1 comprises a base plate 10, a heel-cup frame of a heel-cradling element 20 fastened to the base plate 10, a toe-cradling element 30 fastened to the base plate 10, an instep-strapping arrangement 40, a closure device 50 for the instep-strapping arrangement 40 and a flexible linkage 65 connecting the closure device 50 and the toe-cradling element 30. The flexible linkage 65 is attached to the toe-cradling element at 36. It then passes through a transmission element 60, which may advantageously be a tube or partial tube, which guides the flexible linkage 65. After exiting the transmission element 60, the flexible linkage 65 passes around a guiding element 70, which may be a pulley.

Figure 4:
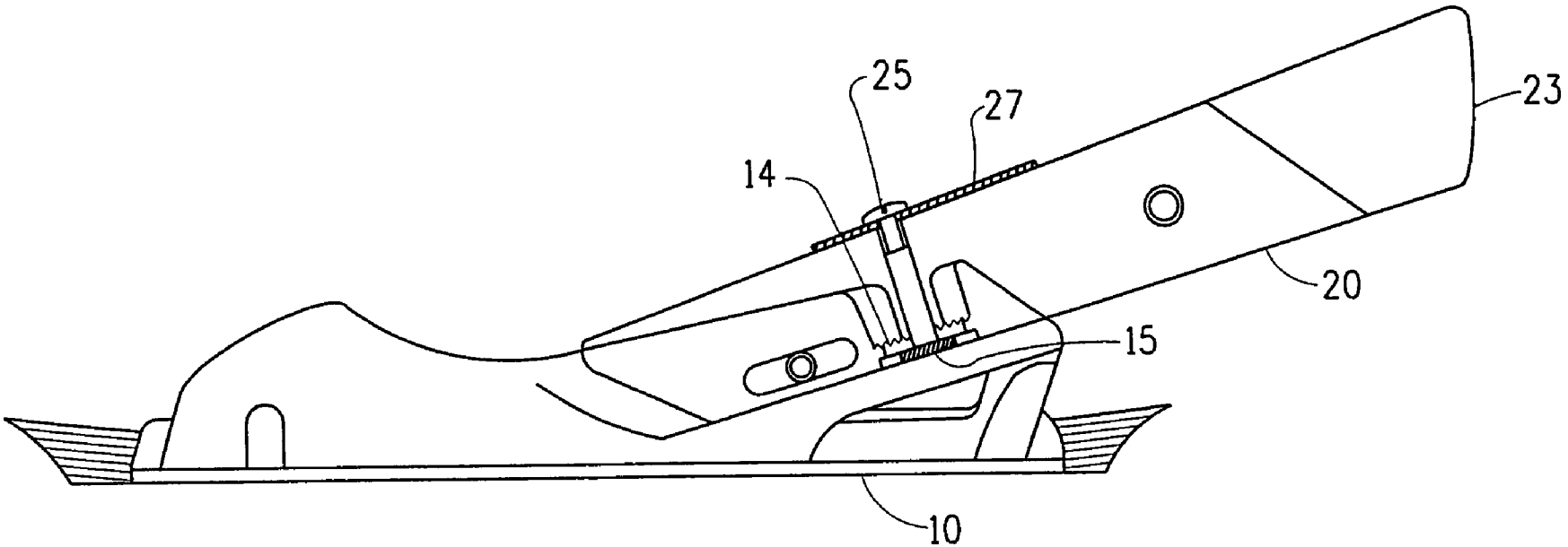
FIG. 4 is a schematic side-elevation of an embodiment of a base plate and heel-cup frame of a snowboard binding according to the invention.

Details of the base plate 10 and the heel-cradling element 20 are described subsequently with reference to FIGS. 4 to 6.

Figure 1:
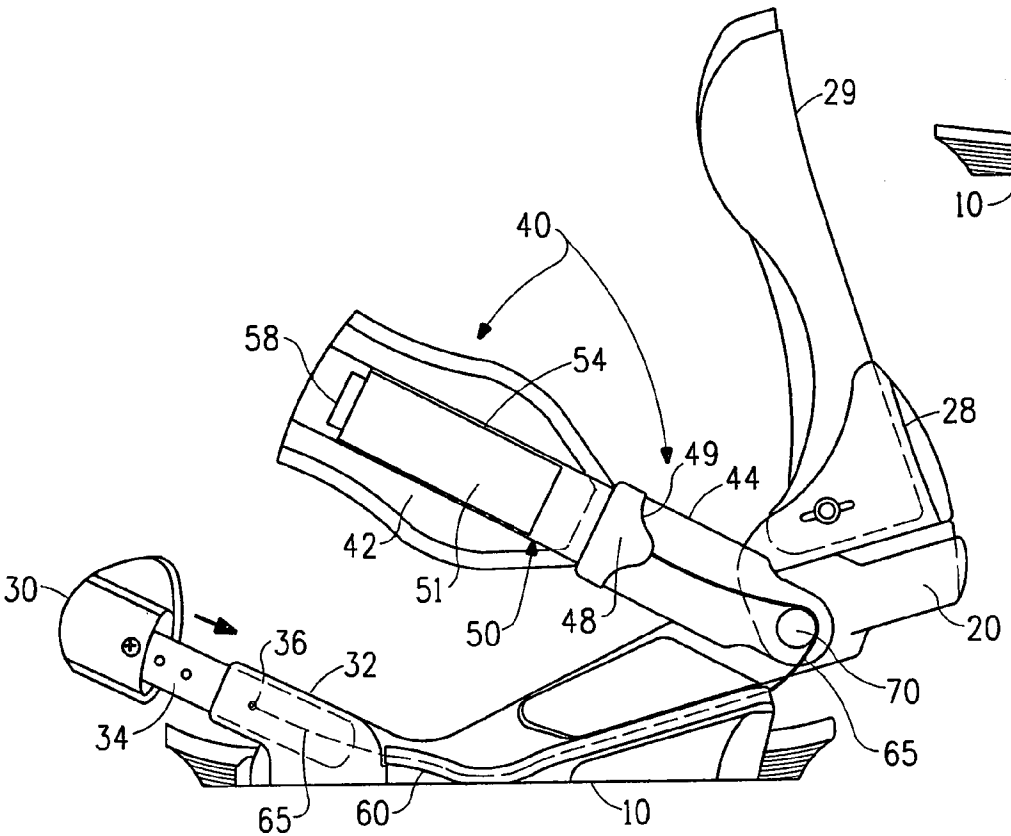
FIG. 1 is a schematic side-elevation of an embodiment of a snowboard binding according to the invention.

With continuing reference to FIG. 1, the toe-cradling element 30 is capable of moving forward and backward relative to a foot placed in the binding. For this, the toe-cradling element 30 is mounted on perforated straps 34 that fit slidably into lateral supports 32 fitted on the front end of base plate 10. The perforations in straps 34 enable the user to adjust centering of the toe-cradling element 30 in the usual way.

In the described embodiment the toe-cradling element 30 is pivotally secured to the base plate 30 at one side only (the side not shown in FIG. 1), allowing the toe-cradling element 30 to move forward and backward on the base plate 10 by pivoting when it is free to do so. As shown, the free end of the visible strap 34 is connected at 36 to one end of the flexible linkage 65.

The instep-strapping arrangement 40 has a main first part 42 connected to one side of the base plate 10 (the opposite side to that shown in FIG. 1) and a second short side part 44 connected to the visible side of base plate 10. The main part 42 extends all the way over the instep area to a free end 46 that meets up with and can overlap with the end of the short side part 44.

The closure device 50 for the instep-strapping arrangement 40 comprises a lever 51 pivotally mounted on the main part 42, a connector 54 slidably mounted on the short side part 44 and an abutment 48 on short side part 44 for limiting sliding of the connector 54. In the closed position of the closure device 50 the lever 51 pulls the connector 54 against the abutment 48 to close the instep-strapping arrangement 40, and in the open position of the closure device 50 the connector 54 is allowed to slide on short side part 44 (see FIG. 3).

Figure 3:
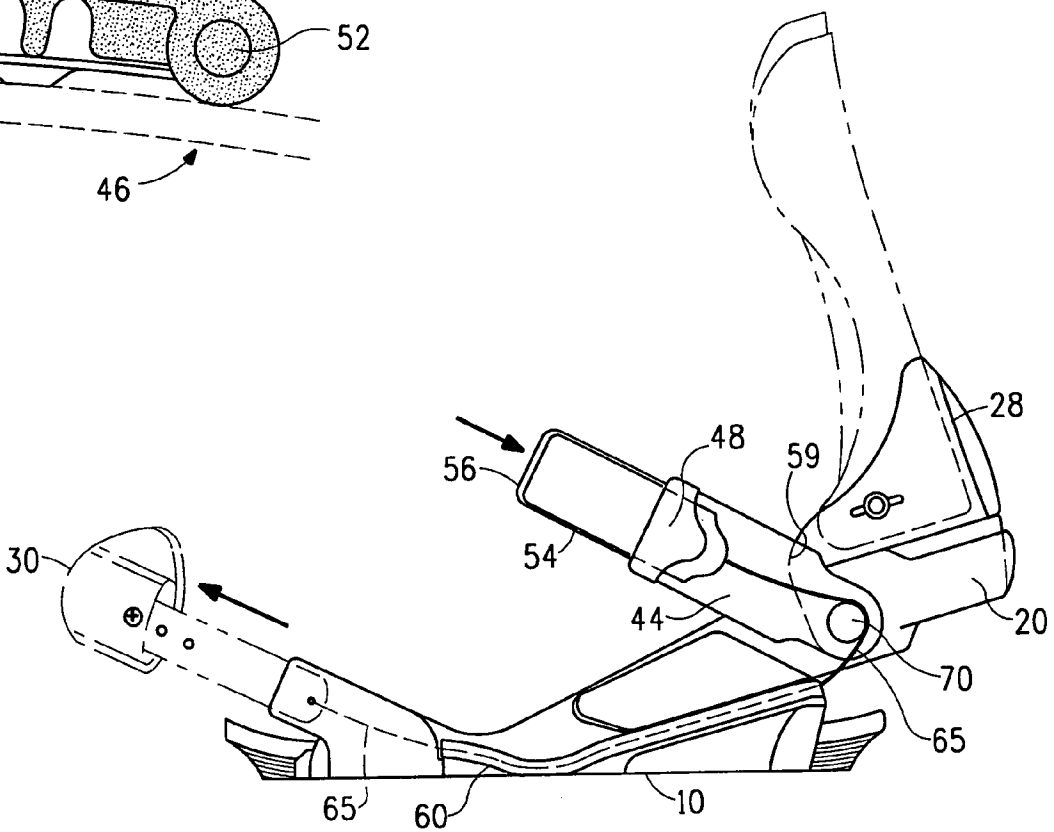
FIG. 3 is a view corresponding to FIG. 1 showing the binding in the open state, leaving off the main body of the instep-strapping arrangement.

As shown in FIGS. 1 and 3, the connector 54 can be a piece in the form of a loop, preferably of metal, having parallel sides that are slidably mounted on the short side part 44, the loop having a protruding end 56 that faces the main part 42 (FIGS. 1 and 2) and that is adapted to engage with the lever 51 (FIGS. 1 and 2), and an opposite end 59 that faces where the short side part 44 is connected with base plate 10. This end 59 of the loop 54 is able to abut against the abutment 48 to limit sliding of the loop 54 (see FIG. 1). The flexible linkage 65 is connected to this end 59 of the loop 54. To maximise force transfer, the abutment 48 has inclined/curved abutment surfaces for engagement of corresponding portions of the end 59 of the loop that are inclined to the loop 54's opposite sides.

Figure 2:
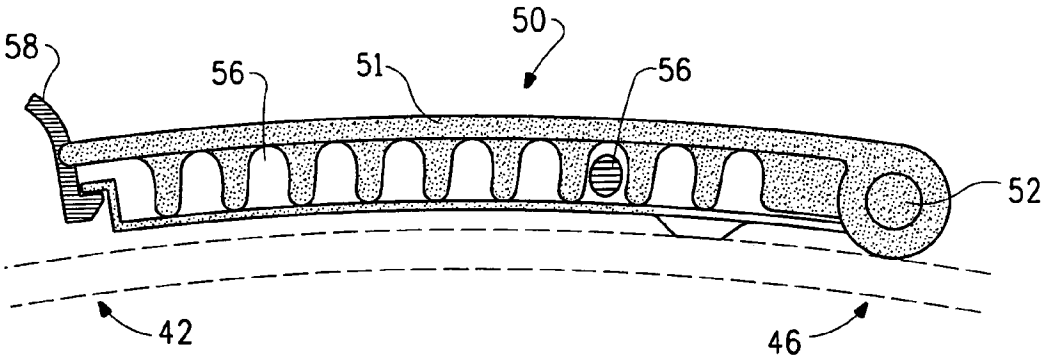
FIG. 2 is a schematic cross-section though a lever of the instep-strapping arrangement's closure member.

The lever 51 of the closure device 50 is pivotally mounted by a pivot 52 near the main part 42's free end 46 (see FIG. 2). On its inside facing the main part 42, the lever 51 has a series of recesses 56 for selective engagement with the protruding end 56 of the loop-like connector 54 to adjust the size of the instep-strapping arrangement when the closure device 50 is in the closed position. This type of "memory" closure is known and is to be contrasted with the "ratchet and ladder" type closure that can be set by feel but not by memory.

Referring again to FIGS. 1 and 2, a safety lock 58 releasably holds the lever 51 in its closed position flat against the main part 42 of the instep-strapping arrangement 40. By moving lock 58, the rider can pull out lever 51, which loosens the flexible linkage 65 so the toe-cradling element 30 is freed to pivot out, facilitating removal of the rider's boot from the binding. When the lever 51 is moved back to the locked position, the lock 58 automatically clips over the end of the lever 51 to hold it locked.

The closure device 50 for the instep-strapping arrangement 40 thus has an open position in which the parts 42,44 of the instep-strapping arrangement 40 are open (FIG. 3) or easy-to-open, and a closed position (FIG. 1) in which parts 42,44 are firmly held together.

The flexible linkage 65 connecting the closure device 50 and the toe-cradling element 30 is arranged such that:

- when the closure device 50 is in the open position the toe-cradling element 30 is free to move forwards and backwards, allowing easy insertion and removal of a boot, and
- when the closure device 50 is in the closed position the flexible linkage 65 transmits a tension to the toe-cradling element 30 to move it backward to fit around a toe part of a foot in the binding, such that the foot is secured between the toe-cradling element 30, the heel-cradling element 20 and the instep-strapping arrangement 40.

When the closure device 50 is in the closed position the held-together parts 42,44 of the instep-strapping arrangement 40 hold a foot securely in the closed instep-strapping arrangement 40 by forces acting between the parts 42,44 through the closure device 50, independently of the need to maintain tension in the flexible linkage 65.

As previously mentioned, the binding provides all of the desirable features of the best conventional two-strap systems, in particular the instep-strapping arrangement 40 provides secure support and safety. The binding is receptive to regular soft boots thus ensuring comfort and better control of a snowboard. The binding is convenient as regards placing a foot/boot in the binding with a step-in function, thanks to the flexible linkage 65. It is also convenient for securing the foot/boot adequately between the instep-strapping arrangement 40 and the toe-cradling element 30, and for releasing the foot/boot.

As described, the side of the toe-cradling element 30 that opens is located on the same side of the binding as the short side part 44 of instep-strapping arrangement 40. This is the same side where the end of lever 51 is accessible to the user for actuation of the closure device 50, and the same side where the instep-strapping arrangement 40 opens up. Having all of the binding's opening functions located on the same side ensures maximum convenience in opening and closing of the binding and insertion and removal of a boot.

Closure of the instep-strapping arrangement 40 is independent of the tension applied by the flexible linkage 65 and guarantees secure strapping of the instep-strapping arrangement 40, whereas the toe-cradling element 30 is held against the toe-part of the foot with a lighter (pre-adjusted) tension. Each part then fulfils its purpose optimally. The instep-strapping arrangement 40 provides the main holding of the foot, whereas the toe-cradling element 30 performs mainly a guiding function. The rider's control of a snowboard is therefore optimized. The flexible linkage 65 does not contribute to the main securing of the foot and can be made of lightweight materials. Even in case of rupture of the flexible linkage 65, the foot remains firmly held in place by the instep-strapping arrangement 40.

The described binding is compatible with existing bindings of the two-strap type and can be supplied either as a complete binding, or as a combined instep-strapping arrangement and closure device adapted to be retro-fitted in an existing two-strap binding, as previously described.

The binding's flexible linkage 65 usually includes at least one cable preferably made of steel or aramid fibre. This cable can be partly sheathed and need extend only along a short distance on one side of the binding. The flexible linkage's cable can be accommodated in recesses provided in the bindings base plate 10 or its fittings, providing a guide path for the flexible linkage within the binding and hence concealed from view and protected from impacts, etc. Two examples of such guide paths are shown in FIGS. 1 and 1A. Conveniently, the base plate 10 and its fittings will have recesses for accommodating a flexible linkage on either side, even though a linkage is needed only on one side. In this way the bindings can be made "universal" for the rider's front or rear foot.

Alternatively, and in particular for retrofitting, the flexible linkage 65 can be mounted externally of the binding, by means of suitable clips.

FIGS. 1 to 3 show the binding with its fittings, ready for use. FIGS. 4 to 6 show in detail the base plate 10 and heel-cup frame 20 of the heel-cradling assembly.

Figure 6:
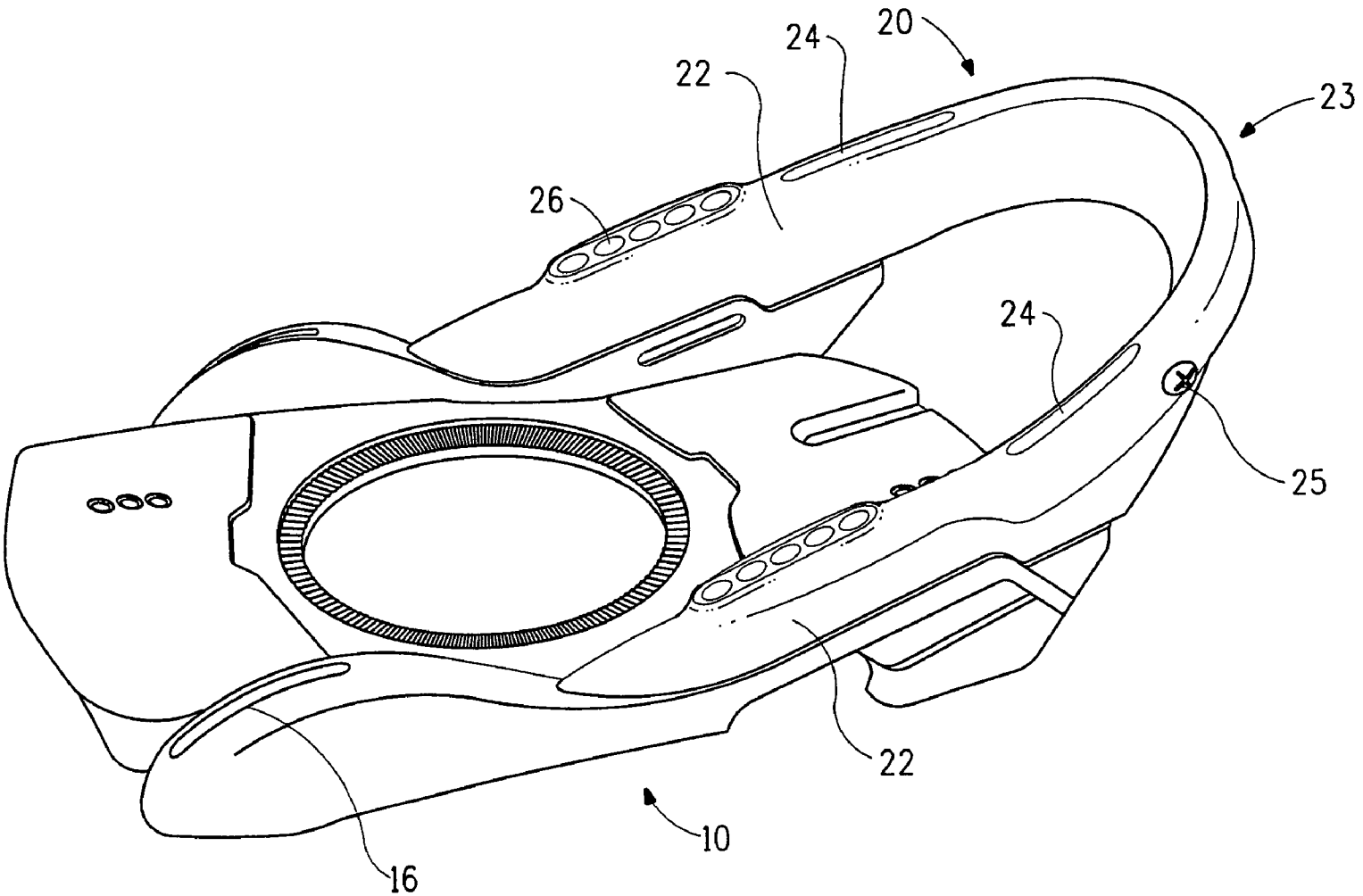
FIG. 6 is a perspective view of a heel-cup frame placed on the base plate.

Referring now to FIG. 6, the heel-cup frame 20 is an integral molded piece of plastics material that is generally of U-shape in plan view, and has spaced (parallel or slightly diverging) arms 22 connected by a curved heel-cradling part 23. The arms 22 fit over opposite sides of the base plate 10. On its rear curved heel-cradling part 23, the heel-cup frame 20 supports any conventional heel-supporting assembly including, for example, an adjustable heel-piece 28 (FIG. 1) and a high back 29 (FIG. 1).

With continuing reference to FIG. 6, the arms 22 of the heel-cup frame 20 have a hollow profile in the form of a downwardly-open longitudinal channel of inverted-U shape.

Figure 5:
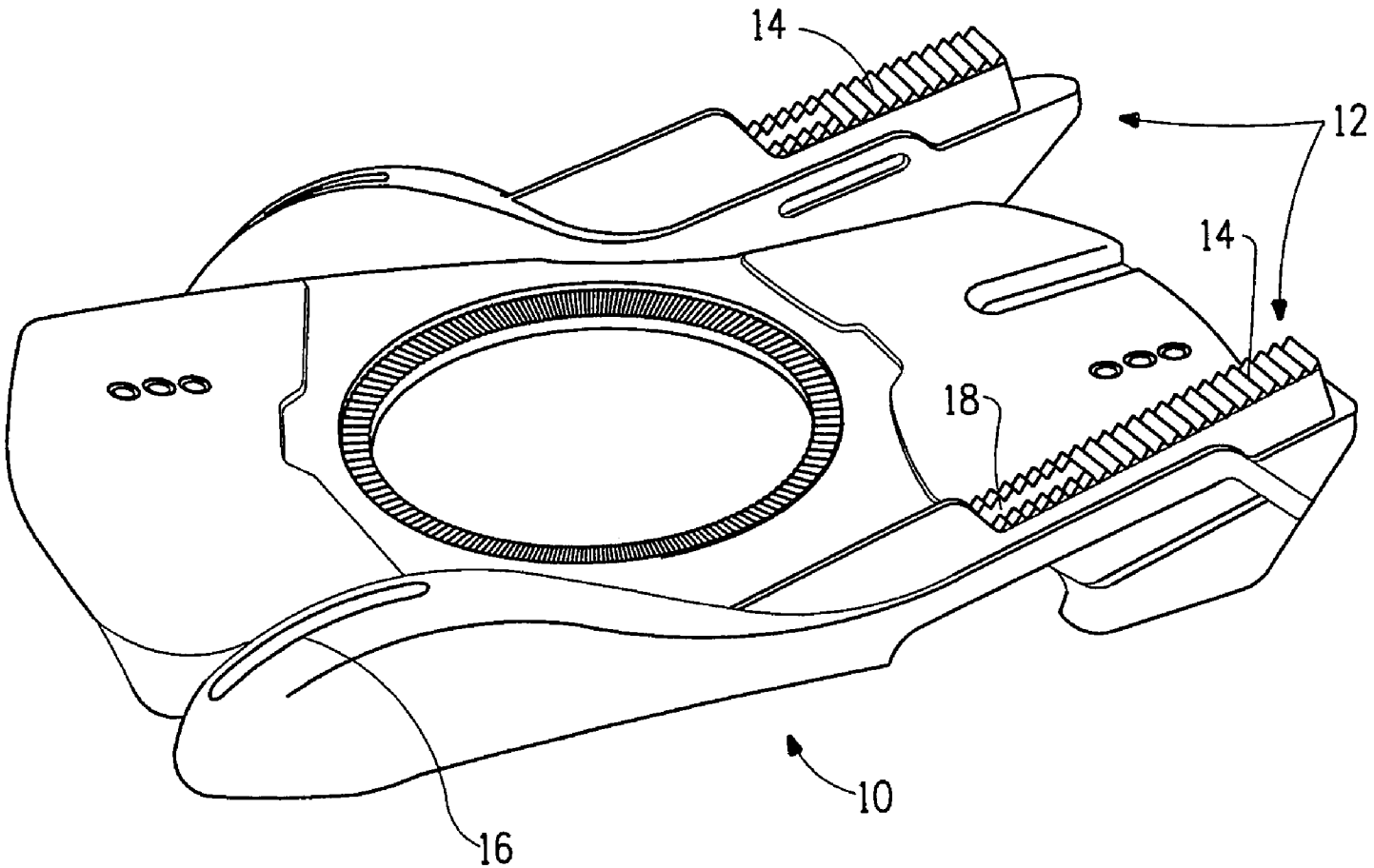
FIG. 5 is a perspective view of the base plate.

Reference is now made to FIG. 5. The base plate 10 has spaced longitudinal guide rails 12 on which the longitudinal channels of the arms 22 slidably engage with a close fit, the sides of the inverted-U profiles fitting closely against sides of the rails 12 with just enough play to allow sliding. Other mating profiles are possible.

Reference again is made to FIG. 6. The fastening means are screws 25 that hold the arms 22 on the guide rails 12 in any selected position. These fastening screws 25 are fitted in the arms 22 and rails 12 (FIG. 5) and are accessible from above the top of the arms 22.

In the illustrated embodiment, the tops of the guide rails 12 (FIG. 5) are inclined at an angle up to 30° to the plane of the base plate 10 so that the arms 22 (FIG. 6) of the heel-cup frame 20 are held inclined at an angle up to 30° to the plane of the base plate 10. This angle, combined with the longitudinal length adjustment of the arms 22 and rails 12, provides a convenient automatic height adjustment in proportion to the size of the rider's boots.

The rails 12 and arms 22 (FIG. 6) can diverge slightly towards the front of the binding, which means that they converge towards the rear to provide the best anatomic fit for the boot heel. This slight divergence/convergence is still possible without interfering with the sliding of the arms, which is possible due to the elasticity and the low friction of the plastic materials used.

Reference is again made to FIG. 6. The fastening means comprise, for each arm 22 and rail 12 (FIG. 5), a single screw 25 passing through an opening 26 in the top of the arm 22 and through a longitudinal slot 18 in the rail 12. The screw 25 engages with a T-nut 15 below the rail 12. A shock-absorber material can be positioned along and around the screw's axis.

The top end of screw 25 is supported on the top of the arm 22 by an elongate washer 27, that extends at least about twice further towards the rear part of the arm 22 than towards the front part. This washer 27 distributes the screw's hold-down effect over a long part of the top of the arm 22, and provides a strong moment about the lower support points. As a result, it is possible with a single screw 25 to assure a very strong support. The thus-fixed heel-cup frame 20 can be subjected to large forces without risk of failure.

The tops of the rails 12 and the inside top part of the downwardly-open longitudinal channel of the arms 22 have cooperating serrations 14 (shown in FIG. 5 for the rails 12) for holding the heel-cup frame 20 in position. The width of the serrations 14 is chosen to set the incremental longitudinal adjustment to fit all boot sizes according to the different norms. In addition to facilitating length adjustment, the serrations 14 contribute to the excellent locking effect achieved by the screws 25.

The arms 22 of the heel-cup frame 20 have apertures 24 for receiving the end parts of an instep-strapping arrangement 42/44, as shown in FIGS. 1 and 3. These apertures 24 are located between the curved heel-cradling part 23 and the fastening means (screws 25 with their openings 26).

The arms 22 and the sides of the base plate 10 also have openings defining a path for receiving a flexible linkage 65 such as a cable (FIGS. 1 and 1A). Conveniently, the base plate 10 and its fittings will have recesses for accommodating a flexible linkage on either side, even though a linkage is needed only on one side. In this way the bindings can be made "universal" for the rider's front or rear foot.

A forward part of the base plate 10 has in its opposite sides, apertures 16 for receiving the end parts 32 of a toe-cradling element 20 (FIG. 1).

Further details of the heel-cradling element/frame and its adjustability are given in the companion patent application of; U.S. application Ser. No. 60/740,753 entitled "Binding with Adjustable Heel-Cup Frame".

It is therefore, apparent that there has been provided in accordance with the present invention, an improved binding that fully satisfies the aims and advantages hereinbefore set forth. While this invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and broad scope of the appended claims.

What is claimed is:

1. A board binding for holding a foot on a flat surface of a board having an opposite side that is adapted to allow the board to be used to slide, roll, or glide said binding comprising:

a base, plate;

a heel-cradling element fastened to the base plate;

a toe-cradling element fastened to the base plate, and capable of moving forward and backward relative to a foot placed in the binding;

an instep-strapping arrangement having a first part connected to one side of the base plate and a second part connected to the other side of the base plate, a closure device for the instep-strapping arrangement, the closure device having an open position in which said first and second parts of the instep-strapping arrangement are open or easy-to-open, and a closed position in which said first and second parts are firmly held together, and a flexible linkage connecting the closure device of the instep-strapping arrangement and the toe-cradling element, the flexible linkage being arranged such that:

when the closure device is in the open position the toe-cradling element is free to move forwards and backwards, and when the closure device is in the closed position the flexible linkage transmits a tension to the toe-cradling element to move it backward to fit around a toe part of a foot in the binding, such that the foot is secured between the toe-cradling element, the heel-cradling element and the instep-strapping arrangement;

wherein when the closure device is in the closed position the held-together first and second parts of the instep-strapping arrangement hold a foot securely in the closed instep-strapping arrangement by forces acting between said first and second parts through the closure device, independently of the need to maintain tension in the flexible linkage.

2. The binding of claim 1, wherein the closure device for the instep-strapping arrangement comprises: a lever pivotally mounted on said first part, a connector slidably mounted on said second part and an abutment on said second part for limiting sliding of the connector, and wherein in the closed position of the closure device the lever pulls the connector against the abutment to close the instep-strapping arrangement, and in the open position of the closure device the connector is allowed to slide on said second part.

3. The binding of claim 1, wherein the flexible linkage includes at least one cable.

4. The binding of claim 1, wherein the toe-cradling element is pivotally secured to the base plate at one side only, allowing the toe-cradling element to move forward and backward on the base plate by pivoting.

5. The binding of claim 1, comprising a heel-cup frame of generally U-shape in plan view, the heel-cup frame having spaced arms connected to opposite sides of the base plate in a manner allowing longitudinal adjustment of the position of the heel-cup frame, and wherein the first and second parts of the instep-strapping arrangement are connected at opposite sides to the two arms of the heel-cup frame.

6. The binding of claim 1, wherein a forward part of the base plate has, in its opposite sides, apertures that receive the ends of the toe-cradling element.

7. The binding of claim 2, wherein the connector is a piece in the form of a loop having parallel sides that are slidably mounted on said second part, the loop having one end that faces the first part and that is adapted to engage with the lever, and an opposite end that faces the connection of the second part with the base plate, said opposite end being able to abut against the abutment to limit sliding of the loop, the flexible linkage being connected to said opposite end of the loop.

8. The binding of claim 2, wherein the abutment has inclined abutment surfaces for engagement of corresponding portions of said opposite end of the loop that are inclined to the loops opposite sides.

9. The binding of claim 2, wherein the lever comprises a series of recesses for selective engagement with the connector to adjust the size of the instep-strapping arrangement when the closure device is in the closed position.

10. The binding of claim 2, wherein said first part of the instep-strapping arrangement is a long part that fits over the instep and said second part is a short side part, and wherein the lever is pivotally connected adjacent to a free end of said first part that fits over the instep, the lever being movable to the closed position by pivoting away from said second part until the lever comes to lay over a portion of said first part in the vicinity of its free end.

11. The binding of claim 2, comprising a safety lock for releasably holding the lever in a closed position.

12. The binding of claim 4, wherein the flexible linkage extends along only one side of the binding, from the instep-strapping arrangement's closure device to the free end of the toe-cradling element.

13. The binding of claim 5, wherein:

the arms of the heel-cup frame have a profile in the form of a downwardly-open longitudinal channel, the base plate has spaced longitudinal guide rails on which the longitudinal channels of the arms slidably engage, and fastening means hold the arms on the guide rails in any selected position, said fastening means being accessible from above the top of the arms.

14. The binding of claim 5, wherein the arms of the heel-cup frame and the sides of the base plate have openings defining a path for receiving the flexible linkage.

15. The binding of claim 13, wherein the tops of the guide rails are inclined at an angle up to 30° to the plane of the base plate so that the arms of the heel-cup frame are held inclined at an angle up to 30° to the plane of the base plate.

16. The binding of claim 13, wherein said rails and said arms converge slightly towards the rear of the binding.

17. The binding of claim 13, wherein the downwardly-open longitudinal channels of the arms have an inverted-U profile, the sides of this profile fitting closely against sides of the rails.

18. The binding of claim 13, wherein said fastening means comprise for each arm/rail a screw passing through an opening in the top of the arm and through a longitudinal slot in the rail, the screw engaging with a nut below the rail.

19. The binding of claim 13, wherein the tops of the rails and the inside top part of the downwardly-open longitudinal channel of the arms have cooperating serrations for holding the heel-cup frame in position.

20. The binding of claim 13, wherein the arms of the heel-cup frame have, between the curved heel-cradling part and the fastening means, apertures that receive the ends of the instep-strapping arrangement.

21. The binding of claim 18, wherein a top end of said screw is supported on the top of the arm by an elongate washer, that preferably extends further towards the rear part of the arm than towards the front part.

22. A combined instep-strapping arrangement and closure device adapted to be fitted in a board binding for holding a foot on a first side of a flat surface having two sides opposite one another wherein a second side of said flat surface is used to slide over other surfaces that second side contacts, said binding comprising: a base plate; a heel-cradling element fastened to the base plate; and a toe-cradling element fastened to the base plate and capable of moving forward and backward relative to a foot placed in the binding;

the combined instep-strapping arrangement and closure device comprising:

an instep-strapping arrangement having a first part connectable to one side of the base plate and a second part connectable to the other side of the base plate, a closure device for the instep-strapping arrangement, the closure device having an open position in which in use said first and second parts of the instep-strapping arrangement are open or easy-to-open, and a closed position in which said first and second parts are firmly held together, and a flexible linkage for connecting the closure device of the instep-strapping arrangement to the toe-cradling element, the flexible linkage being arranged such that, in use:

when the closure device is in the open position the toe-cradling element is free to move forwards and backwards, and when the closure device is in the closed position the flexible linkage is able to transmit a tension to the toe cradling element to move it backward to fit around a toe part of a foot in the binding, such that the foot is secured between the toe-cradling element, the heel-cradling element and the instep-strapping arrangement;

wherein in use when the closure device is in the closed position the held-together first and second parts of the instep-strapping arrangement can hold a foot securely in the closed instep-strapping arrangement by forces acting between said first and second parts through the closure device, independently of the need to maintain tension in the flexible linkage.

23. The combined instep-strapping arrangement and closure device of claim 22, further comprising a toe-cradling element adapted to be fastened to the base plate so as to be capable of moving forward and backward relative to a foot placed in the binding, the toe-cradling element being adapted to be connected to the flexible linkage.

24. The combined instep-strapping arrangement and closure device of claim 22, wherein the toe-cradling element is adapted to be secured to the base plate at one side only, allowing the toe-cradling element to move forward and backward on the base plate by pivoting about its fixed end, and wherein the flexible linkage is arranged to extend along only one side of the binding, from the instep-strapping arrangement's closure device to the free end of the toe-cradling element.

25. The combined instep-strapping arrangement and closure device of claim 22, wherein the closure device of the instep-strapping arrangement is as defined in any of claims 2 to 11.

* * * * *